US007401541B2

(12) United States Patent
McCarroll et al.

(10) Patent No.: US 7,401,541 B2
(45) Date of Patent: Jul. 22, 2008

(54) SERVO-PNEUMATIC ACTUATOR

(75) Inventors: Vincent P. McCarroll, Monroe, CT (US); R. Edwin Howe, New Canaan, CT (US); Blake D. Carter, Norwalk, CT (US); Daniel S. Cook, Terryville, CT (US)

(73) Assignee: Enfield Technlogies, LLC, Trumbull, CT (US)

( * ) Notice: Subject to any disclaimer, the term of this patent is extended or adjusted under 35 U.S.C. 154(b) by 0 days.

(21) Appl. No.: 11/210,196

(22) Filed: Aug. 22, 2005

(65) Prior Publication Data

US 2006/0037467 A1 Feb. 23, 2006

Related U.S. Application Data

(60) Provisional application No. 60/603,453, filed on Aug. 20, 2004.

(51) Int. Cl.
*F15B 15/20* (2006.01)
*F15B 13/04* (2006.01)

(52) U.S. Cl. ..... 91/392; 91/466

(58) Field of Classification Search ..... 91/363 R, 91/392, 466
See application file for complete search history.

(56) References Cited

U.S. PATENT DOCUMENTS 5,424,941 A * 6/1995 Bolt et al. ..... 91/364
5,460,201 A * 10/1995 Borcea et al. ..... 137/625.65
6,755,115 B2 * 6/2004 Stoll et al. ..... 91/363 R

* cited by examiner

*Primary Examiner*—Michael Leslie
(74) *Attorney, Agent, or Firm*—Milton Oliver, Esq.; Ware, Fressola, VDS & Adolphson, LLP

(57) ABSTRACT

A positioning system includes an actuator, valve (preferably pneumatic), position sensor and an electronic valve controller, integrated in a single unit. Continuously variable setpoints are possible within the range of operation. A preferred control circuit includes a signal converter, a ramp generator to smooth the shape of the command or target value signal applied, a position feedback sensor to report the actual position of the actuator, a controller, and a driver, containing an H-bridge, for controlling the pneumatic valve which feeds air into the actuator mechanism. Integration of all these components into a single unit shortens signal paths, improves resistance to electrical noise, and permits faster response time.

4 Claims, 7 Drawing Sheets

Notes:
Numbers in circles map to graphical depiction, not all elements depicted on this functional schematic
Valve, actuator, and plumbing follow ISO fluid power diagram conventions
Controller, driver, and wiring follow commonly accepted simplified circuit diagram conventions
Circuits in controller only show key primary functions; see detailed circuit diagrams

FIG. 1

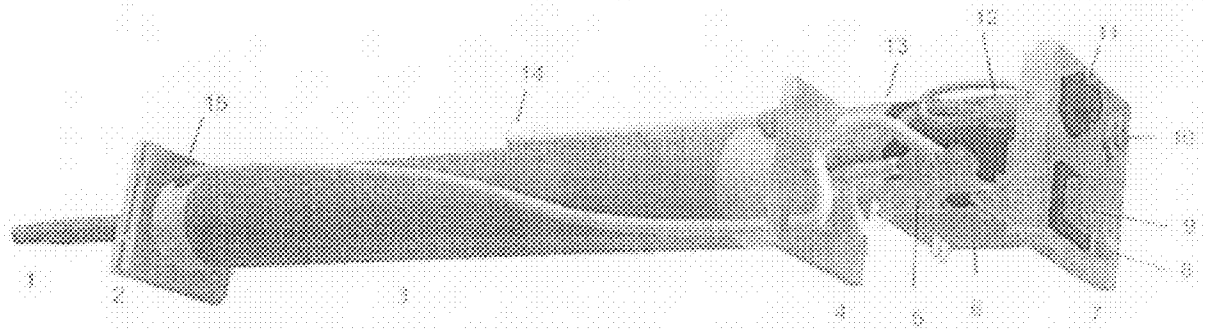

16 (not shown) outer housing skin connecting caps (2, 7) and mid vertical mounting plate (4), with access panel to electronics (6)

| item | description |
|---|---|
| 1 | actuator rod |
| 2 | front cap |
| 3 | actuator air cylinder (containing piston, rod, internal position feedback sensor) |
| 4 | mid vertical mounting plate |
| 5 | mid horizontal mounting plate (for electronics and valve) |
| 6 | controller and driver electronics |
| 7 | back cap |
| 8 | compressed air exhaust port (shown with muffler) |
| 9 | power switch |
| 10 | compressed air input port (shown with quick connect fitting) |
| 11 | power and signal interface connector |
| 12 | wiring harness to electronics and position sensor |
| 13 | 5 port, 4 way electrically actuated directional control valve |
| 14 | air tubing (flexible tubing shown) |
| 15 | port fitting (barbed fitting shown on front actuator port, also used on valve ports) |
| 16 | outer housing skin (not shown) |

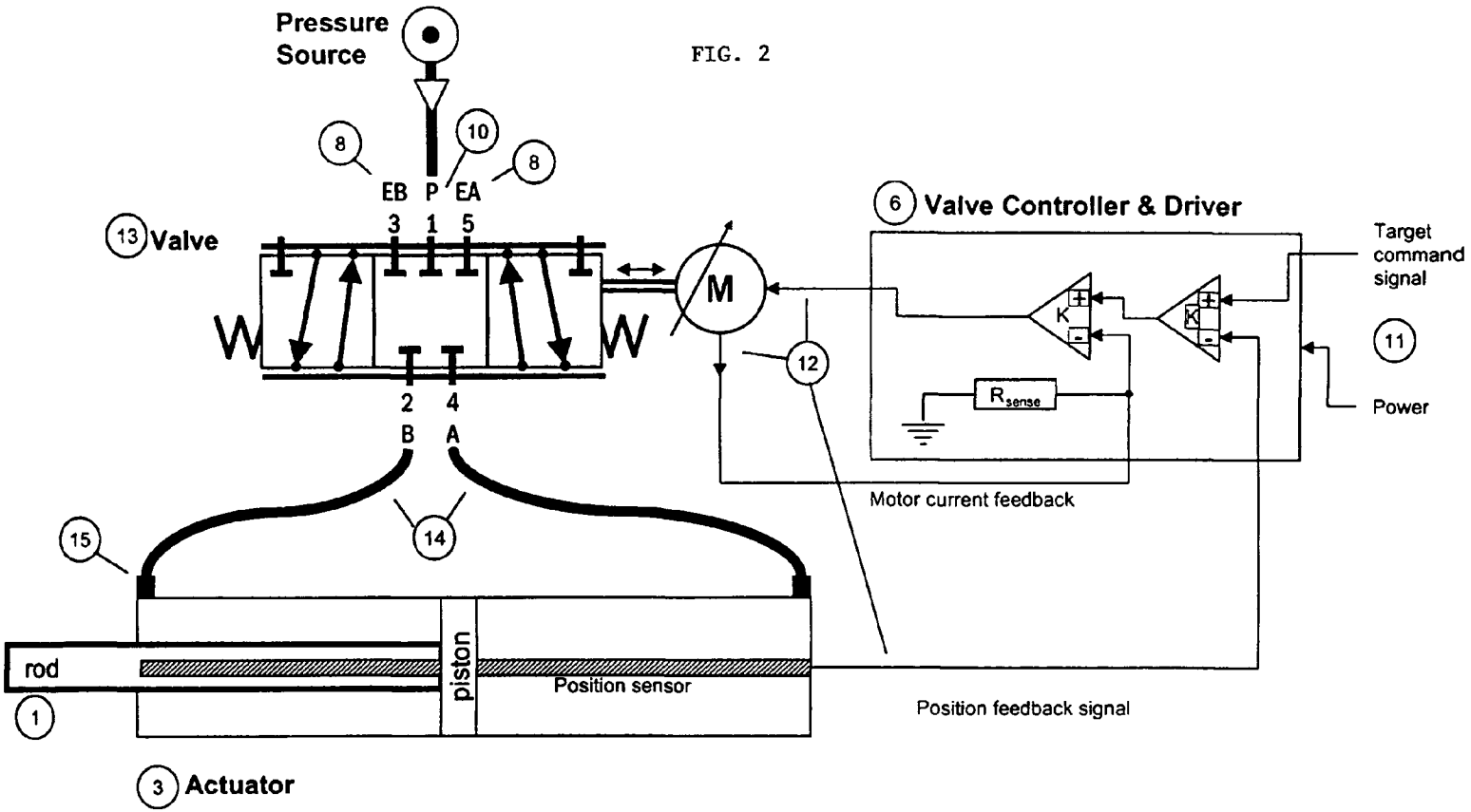

FIG. 2

Notes:
Numbers in circles map to graphical depiction, not all elements depicted on this functional schematic
Valve, actuator, and plumbing follow ISO fluid power diagram conventions
Controller, driver, and wiring follow commonly accepted simplified circuit diagram conventions
Circuits in controller only show key primary functions; see detailed circuit diagrams

SERVO-PNEUMATIC ACTUATOR

CROSS-REFERENCE TO RELATED APPLICATION

This application claims the benefit under 35 U.S.C. §119 (e) of provisional application Ser. No. 60/603,453, filed Aug. 20, 2004, the entire content of which is hereby incorporated by reference.

FIELD OF THE INVENTION

The present invention relates generally to positioning systems and, more particularly, to a pneumatic control valve, for driving an actuator mechanism, which has an electronic feedback control closely integrated with the control valve. We call such a device an "integrated actuator."

BACKGROUND

There are several so-called "integrated actuators" which contain the elements of a valve, fluid power cylinder, and even a sensor, but these prior art products are not in fact fully integrated. Examples include products offered by Enfield Technologies, assignee of the present invention, as well as those from other vendors such as Norgren or Allen Air.

There are also examples of vendors that provide some or all of these elements as individual items or in various forms of sub-assembly which can be assembled as a construction of separate components, but none are unified into a single product and offered as such. Examples include Bimba, Dyval (Parker Hannifin), Festo, Hoerbiger-Origa, and Si-Plan Electronics, Ltd., as well as in research laboratories such as at Vanderbilt, UC Berkeley, and McMaster to name a few academic institutions who have constructed such systems.

However, none provide for fully integrated on-board closed-loop signal processing and control. The commercial need for such a fully integrated product has not been recognized by others working in the art, and the technical challenges to constructing such a device have been formidable. The present invention has overcome these technical challenges.

Industry standard practice has been to configure systems with control systems and power drivers physically separate from actuators. This holds true for both fluid power (hydraulic and pneumatic) systems as well as electromechanical systems (such as linear motors and rotary motor/leadscrew drives).

The challenges have included: the number of valve and valve control devices required to create such a system, and coordination of those devices, control electronics small enough to be placed on-board the actuator itself, and schemes to provide command signals without degradation.

SUMMARY OF THE INVENTION

Accordingly, we have invented a fully integrated position, pressure (including vacuum), or force control system, allowing continuously variable set-points within the respective range of operation, containing the following key performance elements (components or sub-systems):

- a fluid power actuator (pneumatic or hydraulic; linear or rotary),
- actuator sensors (position, pressure, and/or force),
- a fluid power valve (pneumatic or hydraulic; standard or proportional),
- valve controller electronics (integrated driver/controller),

- internal wiring and plumbing for valve, actuator, controller, and sensors,
- encased as a single unit with interfaces for fluid media source (compressed air or pressurized hydraulic fluid), command signals (position, pressure, and/or force set points), and human interfaces (switches and indicators).

ADVANTAGES OVER THE PRIOR ART

We have recognized the need for such a fully integrated product, and have overcome the challenges to construction of such a device. Additional advantages of such a fully integrated system include: ease of specification and application design, simplified installation and maintenance procedures, and unified components protected from damage and environment.

Advantages of the pneumatic system of the present invention, compared with prior art hydraulic systems include; the use of clean, more readily available and familiar compressed air, and size and weight. Advantages with respect to electric motor systems specifically include the ability to achieve higher forces for equivalent physically sized systems.

BRIEF FIGURE DESCRIPTION

FIG. 1 is a perspective view of an integrated pneumatic valve, actuator, and valve controller according to the invention;

FIG. 2 is a simplified schematic diagram illustrating the principal elements of the integrated device of FIG. 1;

DETAILED DESCRIPTION

Figure 3:
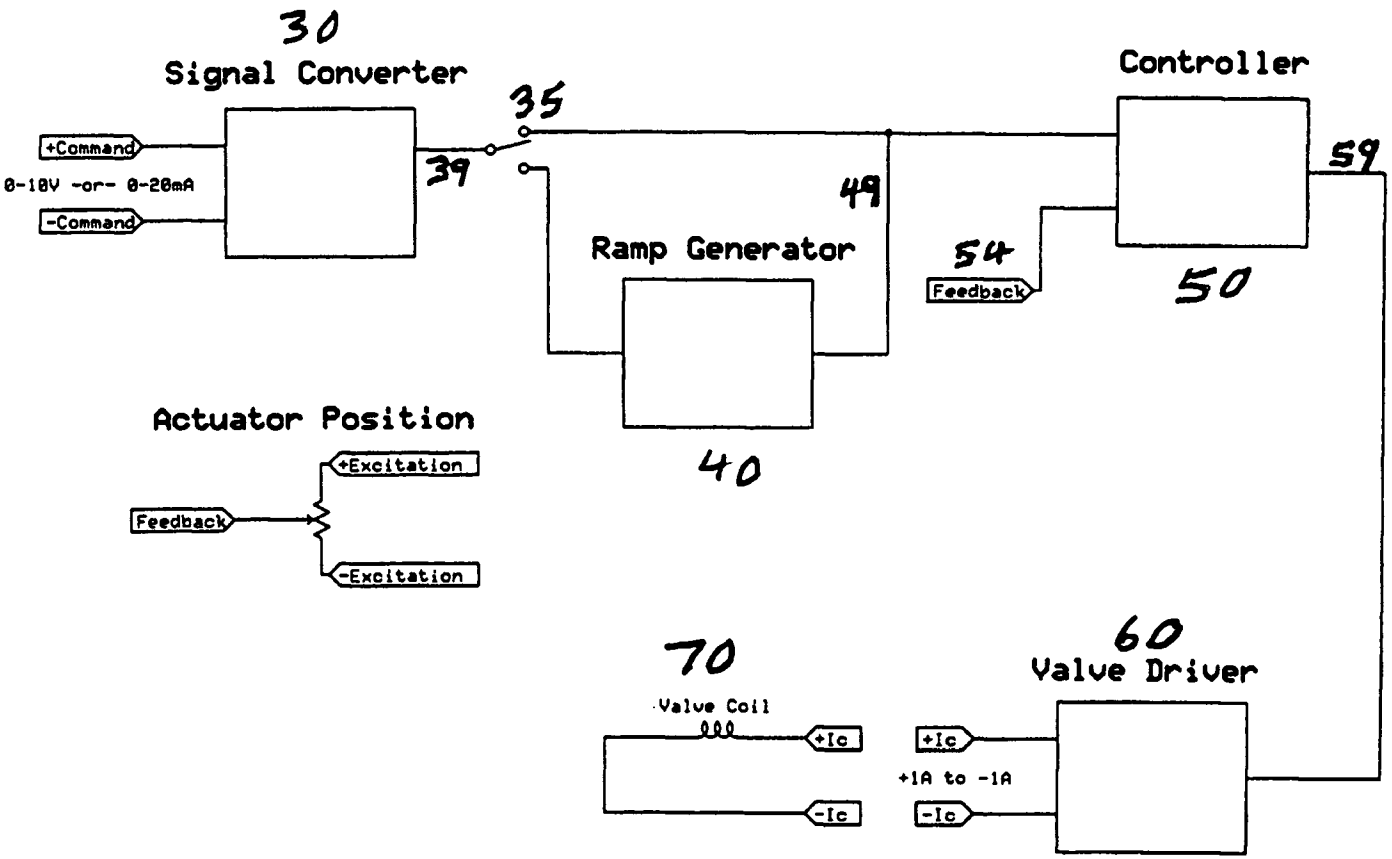
FIG. 3 is a block diagram showing elements of a control circuit for use in the invention.

FIG. 1 shows a preferred embodiment of an integrated pneumatic valve, actuator, and valve controller according to the present invention. A primary application for such a device is to position some object (not shown) which is coupled to a free end of an actuator rod 1. In FIG. 1, the free end is shown at left. A right end of rod 1 is coupled to a piston (not visible in this view) in a conventional manner.

Actuator rod 1 is essentially cylindrical, and slides in and out of an actuator air cylinder 3, which preferably is also a cylinder, having a larger diameter than rod 1. A feedback sensor inside actuator cylinder 3 reports the position of rod 1 to a valve controller 6 which controls a pneumatic valve 13 to modify air pressure within cylinder 3, in order to adjust the linear position of rod 1 with respect to cylinder 3. There is an annular air space inside cylinder 3 between a front cap 2, near the free end of rod 1, and a mounting plate 4 which is essentially perpendicular to a major axis of cylinder 3.

Pneumatic valve 13 can supply air pressure to a right end of cylinder 3, for example via a port in plate 4, to cause rod 1 to extend, and can supply air pressure to a left or front end of cylinder 3, to the left of the piston, for example via tubing to a port 15 adjacent front cap 2, to cause rod 1 to retract.

A back cap 7 is arranged essentially parallel to front cap 2 and mounting plate 4, with pneumatic valve 13 and its valve controller 6 arranged between mounting plate 4 and back cap 7. For example, a horizontal mounting plate 5, supported between back cap 7 and mounting plate 4, can support the valve and valve controller. A wiring harness 12 provides electrical connections between the position sensor, valve 13, valve controller 6, and other elements. Back cap 7 can be equipped with an electrical power switch 9, a compressed air input port 10, and a compressed air exhaust port 8, preferably having a muffler to reduce noise.

The general principle of positioning servo-mechanisms, namely providing a target or command value of position of an actuator, sensing an actual value of actuator position, and attempting to drive the actuator until the actual value matches the target value, is well known in both the pneumatic arts and other branches of engineering. Various types of position sensors are likewise well known, as are the advantages/disadvantages of particular sensor types for particular engineering applications. Historically, one problem with pneumatic positioning servo-mechanisms has been that locating electrical controllers at a distance from the valve and/or from the position sensor(s) renders the signal paths between the elements vulnerable to amplitude drops, electrical noise, and transmission delay. Therefore, the present invention shortens the signal paths by integrating the control electronics with the valve and actuator.

FIG. 3 illustrates a preferred control circuit. A target or command value signal, in the form of a voltage value in the range 0-10 volts or a current value in the range 0-20 milliAmps, is applied to a signal converter 30. An actual actuator position feedback signal is received from a position sensor. The output signal from signal converter 30 is fed, depending upon the setting of a switch 35, either directly to one input of a controller 50, or via a ramp generator 40 to controller 50. Use of a ramp generator as part of the invention is optional, but is preferred because it changes an abrupt "steplike" variation in the target value signal to a sloped or more gradual signal pattern, permitting smoother movement of the valve and actuator elements.

Controller 50 compares the feedback or actual actuator position signal to the target or command signal, and generates an output signal which is applied to the input of valve driver circuit 60. Valve driver circuit 60 has two terminals +Ic and −Ic which are coupled to respective terminals of a voice coil inside pneumatic valve 13. Valve 13 is preferably a spool-and-sleeve valve, structured as disclosed in BORCEA et al. U.S. Pat. Nos. 5,460,201 and 5,960,831, the disclosures of which are hereby incorporated by reference. A preferred embodiment is a 5-port, 4-way electrically actuated directional control valve.

Figure 4:
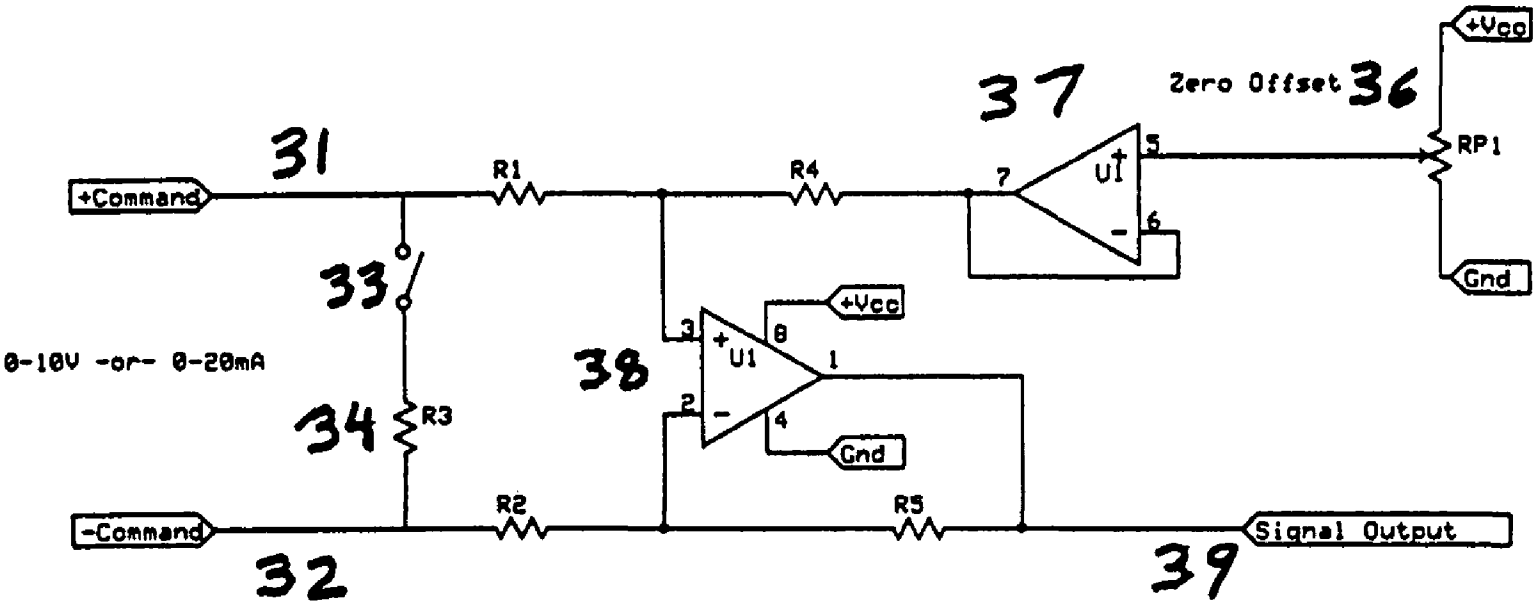
FIG. 4 is a more detailed diagram of the input signal converter or conditioner of FIG. 3.

FIG. 4 is a more detailed diagram of signal converter 30. A positive command signal comes in on line 31 and a negative command signal comes in on line 32. These lines can be connected via a resistor 34 by closing a switch 33. An output from a variable resistor 36 is applied to a positive input terminal of a first op-amp 37, whose output is coupled back to its negative input. This serves to pull up the voltage on positive line 31 to a minimum value set at 36. The output of first op-amp 37 is coupled to the positive input of a second op-amp 38, whose negative input is coupled via a resistor to input signal 32. The output of second op-amp 38 constitutes the signal output 39 of signal converter 30.

Figure 5:
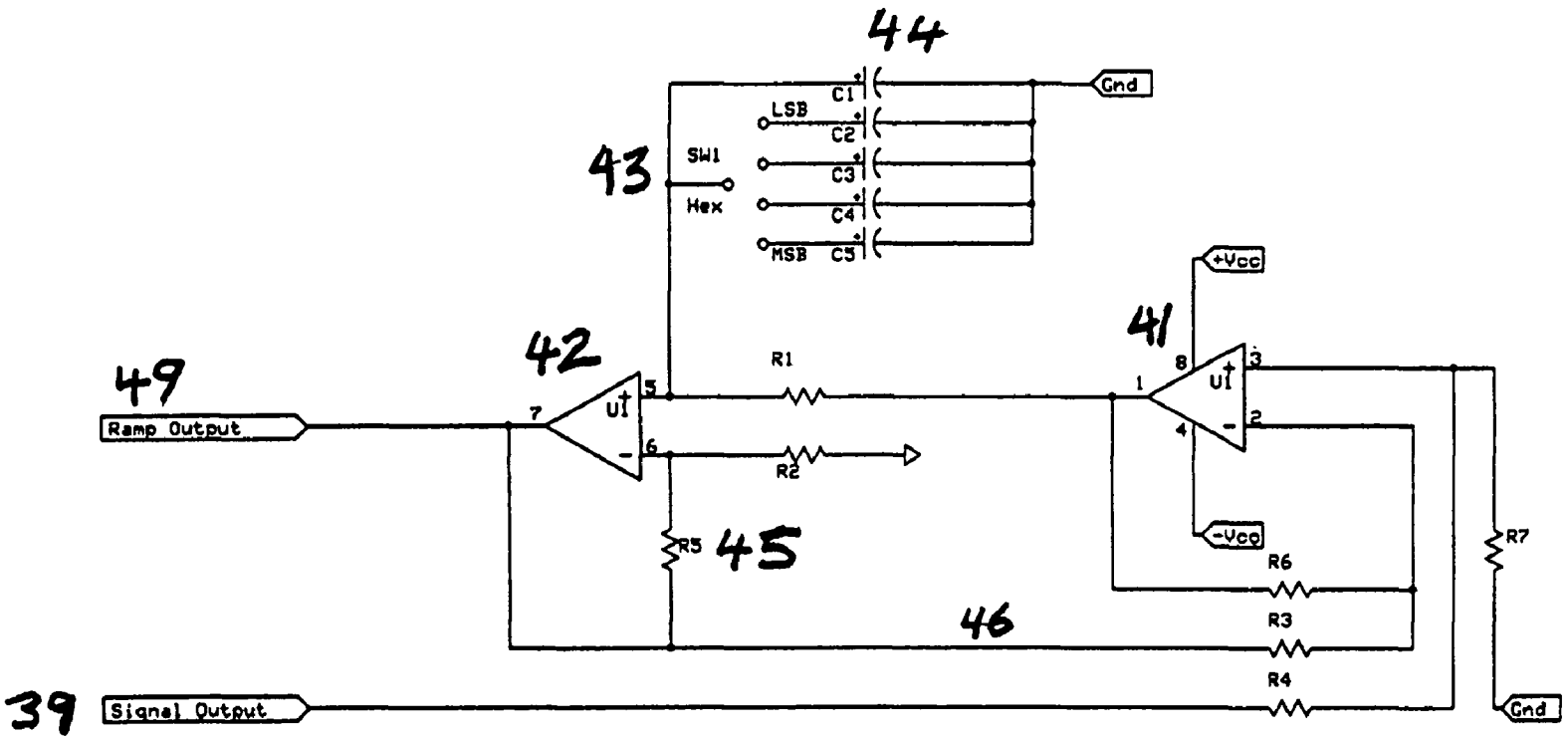
FIG. 5 is a more detailed diagram of the ramp generator of FIG. 3.

FIG. 5 is a more detailed diagram of ramp generator 40. At lower left, signal 39 from converter 30 comes in, and is applied to the positive input terminal of a third op-amp 41, whose output is applied to the positive input terminal of a fourth op-amp 42. The negative input terminal of third op-amp 41 is also connected back via a resistor to its output. The output of fourth op-amp 42 is also coupled via a different resistor to the negative input of third op-amp 41. The positive input terminal of fourth op-amp 42 is also coupled via a switch 43 to a bank of parallel-arranged capacitors 44, whose other terminal is grounded. The function of the capacitor(s) is to charge up in response to a sudden rise in output voltage from op-amp 41 or to discharge in response to a sudden drop in output voltage from op-amp 41, thereby turning a "steplike" voltage change into a "ramped" voltage change, as previously described, and softening the abruptness of actuator rod motion. The slope of the ramp depends upon which capacitance is selected by switch 43. The negative input terminal of fourth op-amp 42 is connected via a resistor 45 to the line 46 connecting the output of 42 back to the negative input of op-amp 41. The output of fourth op-amp 42 constitutes the ramp output 49 which is then applied to the "target value" input of controller 50.

Figure 6:
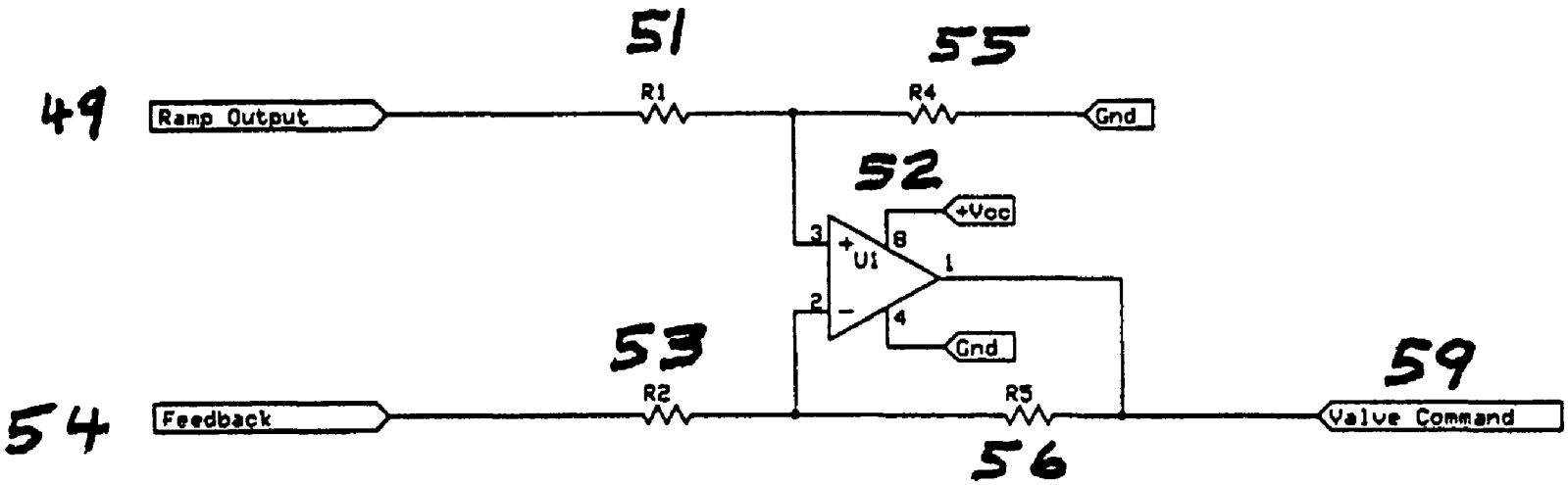
FIG. 6 is a more detailed diagram of the convergence controller of FIG. 3.

FIG. 6 is a more detailed diagram of controller 50. Ramp output signal 49 comes in at top left and is applied, via a resistor 51 to the positive input of a fifth op-amp 52, whose negative input is coupled via a resistor 53 to actual actuator position feedback signal 54. The positive input of op-amp 52 is also connected via a resistor 55 to ground. The output of op-amp 52 is coupled back via a resistor 56 to its negative input. The output signal from op-amp 52 constitutes the controller output signal 59 which is applied to the input of valve driver 60.

Figure 7:
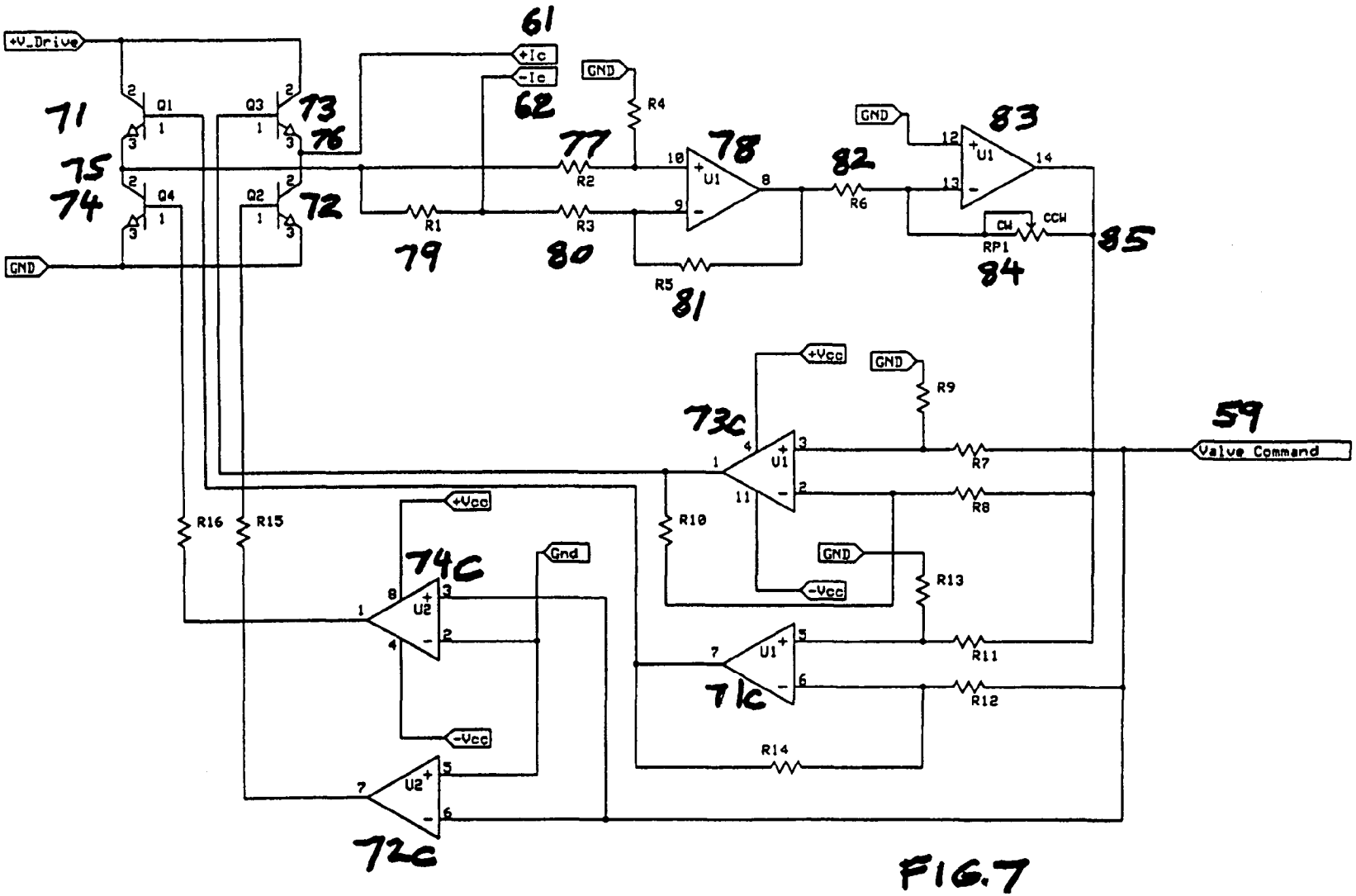
FIG. 7 is a more detailed diagram of the valve driver of FIG. 3.

FIG. 7 is a more detailed diagram of the valve driver 60, which includes an H-bridge circuit for controlling the driving current applied to first and second terminals 61 and 62 of a voice coil inside control valve 13. The H-bridge consists of four transistors 71-74, each of whose gates is controlled by the output of a respective op-amp 71C, 72C, 73C, 74C. Only two of the transistors conduct at a given time. When transistors 71 and 72 are conductive, current flows from V+ via transistor 71 and node 75 to into voice coil terminal 62, out voice coil terminal 61 and back via node 76 and transistor 72 to ground. This is one direction of current flow. For current flow through the voice coil in the opposite direction, transistors 73 and 74 must conduct. Then, current flows from V+ via transistor 73 and node 76 into voice coil terminal 61, and back out from terminal 62 via node 75 and transistor 74 to ground.

The lower half of FIG. 7 shows the control of the H-bridge transistors. Controller output signal 59 is applied to the positive inputs of op-amps 73C and 74C and to the negative inputs of op-amps 71C and 72C. A signal from node 75 is applied via a resistor 77 to the positive input of a sixth op-amp 78 and via resistors 79 and 80 of the negative input of op-amp 78. Resistor 79 is in the path between node 75 and terminal 62, while resistor 80 is in the path between terminal 62 and op-amp 78. The output of op-amp 78 is coupled via a resistor 81 back to its negative input. The output of op-amp 78 is also coupled via a resistor 82 to the negative input of a seventh op-amp 83, whose positive input is grounded. Op-amp 83 is connected in parallel with a variable resistor 84. The output terminal of op-amp 83 and one terminal of variable resistor 84 are connected to a node 85. The voltage at node 85 is connected to the positive input of op-amp 71C and to the negative input of op-amp 73C. Thus, when the voltage at node 85 goes high, op-amp 71C turns on transistor 71 and op-amp 73C turns off transistor 73. Conversely, when the voltage at node 85 goes low, op-amp 71C turns off transistor 71 and op-amp 73C turns on transistor 73. The positive input of op-amp 72C and the negative input of op-amp 74C are connected to ground. In this manner, the value of output signal 59 of controller 50 determines whether current is applied to the voice coil terminals 61, 62 and in which direction.

Various changes and modifications are possible within the scope of the inventive concept. For example, a hydraulic valve, rather than a pneumatic valve, could be used. Further, a rodless cylinder, rather than a single rod cylinder, could be used. Therefore, the invention is not limited to the specific embodiments shown and described, but rather is defined by the following claims.

What is claimed is:

1. An integrated electronically actuated fluid power actuator, comprising:

a movable actuator portion (1);

a stationary actuator portion (3) arranged adjacent said movable portion and adapted to receive (14, 15) a fluid for moving said movable portion (1)

means for sensing a position of said movable portion (1) with respect to said stationary portion (3);

a pneumatic fluid power valve (13) adapted to supply at least one fluid to said stationary actuator portion (3);

a valve controller (6) containing means (50) for comparing a target position for said movable actuator portion with an actual position, as detected by said sensing means, means for generating a sequence of command signals to said fluid power valve, to thereby supply fluid through said valve (13) to said stationary actuator portion (3), to bring said movable actuator portion (1) to said target position, a signal converter (30), and a valve driver (60), wherein the valve driver includes an H-bridge circuit (71-74) and the valve includes a voice coil.

2. The integrated actuator of claim 1, further comprising a ramp generator (40), connected between said signal converter (30) and said means for comparing (50), to smooth abrupt signal changes.

3. An integrated electronically actuated fluid power actuator, comprising:

a movable actuator portion (1);

a stationary actuator portion (3) arranged adjacent said movable portion and adapted to receive (14, 15) a fluid for moving said movable portion (1);

means for sensing a position of said movable portion (1) with respect to said stationary portion (3);

a hydraulic fluid power valve (13) adapted to supply at least one fluid to said stationary actuator portion (3);

a valve controller (6) containing means (50) for comparing a target position for said movable actuator portion with an actual position, as detected by said sensing means, means for generating a sequence of command signals to said fluid power valve, to thereby supply fluid through said valve (13) to said stationary actuator portion (3), to bring said movable actuator portion (1) to said target position, a signal converter (30), and a valve driver (60), wherein the valve driver includes an H-bridge circuit (71-74) and the valve includes a voice coil.

4. The integrated actuator of claim 3, further comprising a ramp generator (40), connected between said signal converter (30) and said means for comparing (50), to smooth abrupt signal changes.

* * * * *